US006866257B2

(12) United States Patent
Brünner et al.

(10) Patent No.: US 6,866,257 B2
(45) Date of Patent: Mar. 15, 2005

(54) GATHERING-STITCHING MACHINE HAVING A GUIDE ELEMENT IN THE STITCHING REGION

(75) Inventors: Torsten Brünner, Leipzig (DE); Siegmar Tischer, Borsdorf (DE); Detlef Hempel, Markranstädt (DE); Steffen Hoffmann, Leipzig (DE); Eberhard Reichardt, Leipzig (DE); Thomas Wuttke, Leipzig (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 30 days.

(21) Appl. No.: 10/186,112

(22) Filed: Jun. 28, 2002

(65) Prior Publication Data

US 2003/0001327 A1 Jan. 2, 2003

(30) Foreign Application Priority Data

Jun. 28, 2001 (DE) ..... 101 30 662

(51) Int. Cl.[7] ..... B42B 2/02
(52) U.S. Cl. ..... 270/52.26; 270/52.29
(58) Field of Search ..... 270/52.26, 52.29, 270/52.18

(56) References Cited

U.S. PATENT DOCUMENTS 3,786,979 A 1/1974 Müller
4,236,706 A 12/1980 Schlough
5,375,824 A * 12/1994 Anker et al. ..... 270/52.29
5,667,212 A 9/1997 Merkli
6,059,093 A 5/2000 Merkli
6,142,353 A 11/2000 Boss et al.
6,270,068 B1 * 8/2001 Cracknell ..... 270/52.26
6,315,107 B1 * 11/2001 Muller et al. ..... 198/606

FOREIGN PATENT DOCUMENTS

DE 2 007 831 8/1971
EP 0 916 514 A1 5/1999

* cited by examiner

*Primary Examiner*—Christopher P. Ellis
*Assistant Examiner*—Mark A. Deuble
(74) *Attorney, Agent, or Firm*—Laurence A. Greenberg; Werner H. Stemer; Ralph E. Locher

(57) ABSTRACT

A stitching device includes at least one stitching station having an inlet region and an outlet region, and a transport device for conveying a plurality of folded signatures to the stitching station through the inlet region for stitching the plurality of folded signatures and for conveying the stitched plurality of folded signatures away from the stitching station through the outlet region, and further including a guide element for supporting the plurality of folded signatures during transport thereof through at least one of the inlet and the outlet regions; and a gathering-stitching device including the stitching device.

10 Claims, 4 Drawing Sheets

GATHERING-STITCHING MACHINE HAVING A GUIDE ELEMENT IN THE STITCHING REGION

BACKGROUND OF THE INVENTION

Field of the Invention

The invention relates to a stitching device with at least one stitching station having an inlet region and an outlet region, and also a transport device for guiding a plurality of folded signatures to the stitching station through the inlet region for stitching the plurality of folded signatures, and for guiding the stitched plurality of folded signatures away from the stitching station through the outlet region.

Devices for stitching folded signatures and printed products, respectively, are typically provided in so-called gatherer-stitchers or gathering-stitching machines. Such gathering-stitching machines, which separate folded printed products individually, deposit them on a transport device, such as a transport chain or the like, collect and collate the printed products and then feed them to a stitching station and, subsequently, if necessary, to a further processing unit, such as an edge trimming device, a delivery or the like, have become known heretofore.

For example, the published European Patent Application EP 0 916 514 A1 discloses a typical gathering and stitching machine having a front and a rear gathering chain serving as the transport device. Individual folded sheets or folded signatures are individually separated or singled from piles thereof by folded sheet feeders, are opened and are deposited onto the gathering chains. Arranged between the gathering chains is a guide bar having an upper section formed like a cutter and having a ridge line establishing the transport and stitching line. Together with the guide bar, the gathering chains form a somewhat roof-like support, whereon the folded sheets or folded signatures are transported in a straddling manner. In order to grip the folded sheets deposited onto the gathering chains securely, even at a high transport speed, and to load them uniformly, the gathering chains and the entrainers or drivers thereof, respectively, run in front of and behind the guide bar, so that a deposited folded sheet is gripped simultaneously at both leaves thereof. The folded sheets gripped by the drivers or entrainers are transported by the front and the rear gathering chain to a stitching station, wherein folded sheets lying on one another or a plurality of folded signatures are stitched at the fold thereof with the aid of a staple, more particularly a wire staple. For this purpose, there are provided stitching heads, which are arranged above the gathering chain, and clincher boxes, which are arranged between the gathering chains instead of the guide bar and which bend over the free ends of the staples stuck through the folded sheets by the stitching heads. The stitched folded sheets or folded signatures are then conveyed onwardly by at least one of the gathering chains to further processing, for example, for edge trimming, or for delivery.

Heretofore, adjustable devices for guiding gathered printed products have been used in gathering-stitching machines. For machines with continuous gathering chains, such as various conventional gathering-stitching machines from known manufacturers, both the front chain and the rear chain, respectively, can be adjusted in height, in particular based upon the product thickness. Typically used guide elements can, in this regard, for example, support the printed products from above with respect to the sheet-metal track, but only to a limited extent prevent tilting or collision of the leading printed product edges or smaller inner edges, for example of inserted cards, against the guide elements moving in the opposite direction to the stitching station. For diverse printed products, this can possibly lead to disruptions in the inlet and outlet of the stitching region due to stoppages, misfed sheets or the like, so that downtimes of the gathering-stitching machine often result. For continuous transport devices, in particular gathering chains, it is furthermore necessary to provide a chain guide that is adjustable in height. A deflection of the gathering chain often leads, however, to increased wear or drive problems. In general, the front chain of the transport device should additionally be removable or able to be taken off from the rest of the machine in a relatively simple manner, so that the stitching region is accessible to the operator conveniently when required, which is made more difficult by a chain guide that is adjustable in height.

For stabilizing and/or quieting the folded-sheet or signature stream, it is generally usual to provide rollers or hold-back springs, which act upon the rear of the folded signatures, and/or guide elements above the folded signatures, which prevent a the rising up of a plurality of the folded signatures at the inlet into or outlet from the stitching region. Furthermore, it has become known heretofore from U.S. Pat. No. 6,059,093, to provide airflow diverters on the transport device so that, even at high transport speeds, folded sheets located on the transport device are not blown upwardly by the airflow but can be held down by turbulence.

Despite these measures, however, small folded signatures or inserted cards actually tend to collide with guides of the stitching station, which are movable relative to the transport device, and tend to tilt into free regions located upline or downline from the stitching station. For specific sheet formats, the oppositely-running leading edge of the stitching carriage can grip and damage parts of the sheet. It is consequently possible for stoppages to occur.

SUMMARY OF THE INVENTION

It is accordingly an object of the invention to provide a gathering-stitching machine having a guide element in the stitching region, wherein a run of folded sheets or signatures in the stitching region is improved, and downtime resulting from disruptions in the inlet and outlet of the stitching region is shortened.

With the foregoing and other objects in view, there is provided, in accordance with one aspect of the invention, a stitching device comprising at least one stitching station having an inlet region and an outlet region, and a transport device for conveying a plurality of folded signatures to the stitching station through the inlet region for stitching the plurality of folded signatures and for conveying the stitched plurality of folded signatures away from the stitching station through the outlet region, and further comprising a guide element for supporting the plurality of folded signatures during transport thereof through at least one of the inlet and the outlet regions.

In accordance with another feature of the invention, the stitching device further comprises at least one support point located at least approximately in the fold of the innermost signature of the plurality of folded signatures and serving for supporting the plurality of folded signatures starting from a side of the transport device.

In accordance with a further feature of the invention, the stitching device further comprises at least another support point, so that the support of the plurality of folded signatures is effected from the side of the transport device by a feature selected from the group consisting of at least two support points having a connecting line extending at least approximately parallel to the fold of the plurality of folded signatures, and consisting of a support line.

In accordance with an added feature of the invention, the connecting line and the support line are formed at least approximately by the fold of the plurality of folded signatures.

In accordance with an additional feature of the invention, the guide element extends at least approximately over an entire section from an inlet to an outlet.

In accordance with yet another feature of the invention, at least part of the stitching station is movable relative to the transport device so that, while at least one staple is being driven into the plurality of folded signatures, the relative speed between the parts of the stitching station and the plurality of folded signatures moved by the transport device is at least approximately zero.

In accordance with yet a further feature of the invention, the guide element has at least one support point which is movable together with the plurality of folded signatures during transport thereof, at least by sections, at an at least approximate relative speed of zero.

In accordance with yet an added feature of the invention, the guide element is realized at least partly as at least one of a movable metal sheet; a rod; at least two relatively movable interleaved metal sheets; at least two relatively movable stacked rods; and a cable.

In accordance with yet an additional feature of the invention, the cable is a steel cable.

In accordance with another feature of the invention, the transport device extends, at least in some sections, from a feeder disposed upline from the stitching station for individually separating folded signatures and for depositing the separated signatures on the transport device for additionally gathering and collating the plurality of folded signatures, over the stitching station to a further device disposed downline.

In accordance with another aspect of the invention, there is provided a gathering-stitching machine having a stitching device comprising at least one stitching station having an inlet region and an outlet region, and a transport device for conveying a plurality of folded signatures to the stitching station through the inlet region for stitching the plurality of folded signatures and for conveying the stitched plurality of folded signatures away from the stitching station through the outlet region, and further comprising a guide element for supporting the plurality of folded signatures during transport thereof through at least one of the inlet and the outlet regions.

According to the invention, the stitching device comprises at least one stitching station having an inlet region and an outlet region, and also a transport device for conveying a plurality of folded signatures to the stitching station through the inlet region for stitching the plurality of folded signatures, and for conveying the stitched plurality of folded signatures away from the stitching station through the outlet region. It is distinguished by the fact that a guide element is provided for supporting the plurality of folded signatures during the transport thereof through the inlet regionarea and/or through the outlet region.

In this regard, the further device located downline can be a delivery, a further processing station, such as a cutting device, or preferably a staple inspection or control region.

According to the invention, the support of the plurality of folded signatures, starting from the side of the transport device, is preferably performed by at least one support point, which is located at least approximately within the fold of the innermost signature of the plurality of folded signatures. Particularly advantageous is the support from the side of the transport device by at least two support points having a connecting line extending at least approximately parallel to the fold of the plurality of folded signatures, or by a support line. In a preferred embodiment of the invention, the connecting line or support line is virtually formed by the fold of the plurality of folded signatures. This support line which is real or imaginary, as in the case of the support points, then advantageously coincides with the stitching line.

In addition to the method of stitching a plurality of folded signatures when there is a standstill, i.e., following a braking to a relative speed of at least approximately zero at the stitching station, a familiar method calls for performing stitching during the virtually uniform movement of the plurality of folded signatures on the transport device, by the stitching station also being at least partially moved relative to the plurality of folded signatures at an at least approximate relative speed of zero. Then, at least part of the stitching station can be moved relative to the transport device so that, while at least one staple is being driven into the plurality of folded signatures, the relative speed between the parts of the stitching station and the plurality of folded signatures is at least approximately zero. The device according to the invention preferably performs stitching with entrained or following travel and, expressed in other words, it is a device for synchronous stitching.

It is particularly advantageous if at least one support point of the guide element is movable along with the plurality of folded signatures during the transport, at least in some sections, at a relative speed of at least approximately zero. Expressed in other words, the device according to the invention therefore comprises an entrained traveling stitching line for entrained or synchronous stitching.

By the device according to the invention, which has a stationary guide element or an entrainingly or synchronously traveling guide element, depending upon the stitching method upon which it is based, tilting of relatively small folded sheets into the oscillating interspaces is prevented. The guide element therefore preferably extends at least approximately entirely over the section extending from the inlet into the stitching station to the element arranged downline.

In a preferred embodiment of the invention, the guide element is realized or implemented at least partly as a movable metal sheet and/or as at least one rod and/or as at least two relatively movable interleaved metal sheets and/or as at least two relatively movable stacked rods and/or as a cable, in particular a steel cable. According to the invention, only a small number of simple guide elements is required in order to improve the running or travel of the plurality of folded signatures in the region of the stitching station. By closing the gaps in the stitching region and staple inspection region by various elements, such as movable or interleaved metal sheets, cables or guide elements above or below the stitching line, the product stream is improved.

A stitching device according to the invention is preferably combined, particularly advantageously, with a gathering machine or collating machine. Expressed in another way, the transport device extends at least in some sections from a feeder arranged upline from the stitching station for separating folded signatures and for depositing the individually separated signatures on the transport device for the additional gathering and collating of the plurality of folded signatures, over the stitching station as far as the further device arranged downline.

The use of the stitching device according to the invention is particularly advantageously performed in a gathering-stitching machine. A gathering-stitching machine of this type according to the invention is distinguished by the fact that the gathering-stitching machine has at least one stitching device according to the invention. By the device according to the invention, sheet travel in the stitching region of the gathering-stitching machine is improved. Gaps in the stitching region of the gathering-stitching machine, which are necessitated by the design thereof, are bridged.

Other features which are considered as characteristic for the invention are set forth in the appended claims.

Although the invention is illustrated and described herein as embodied in a gathering-stitching machine having a guide element in the stitching region, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings:

DESCRIPTION OF THE PREFERRED EMBODIMENTS

Figure 1:
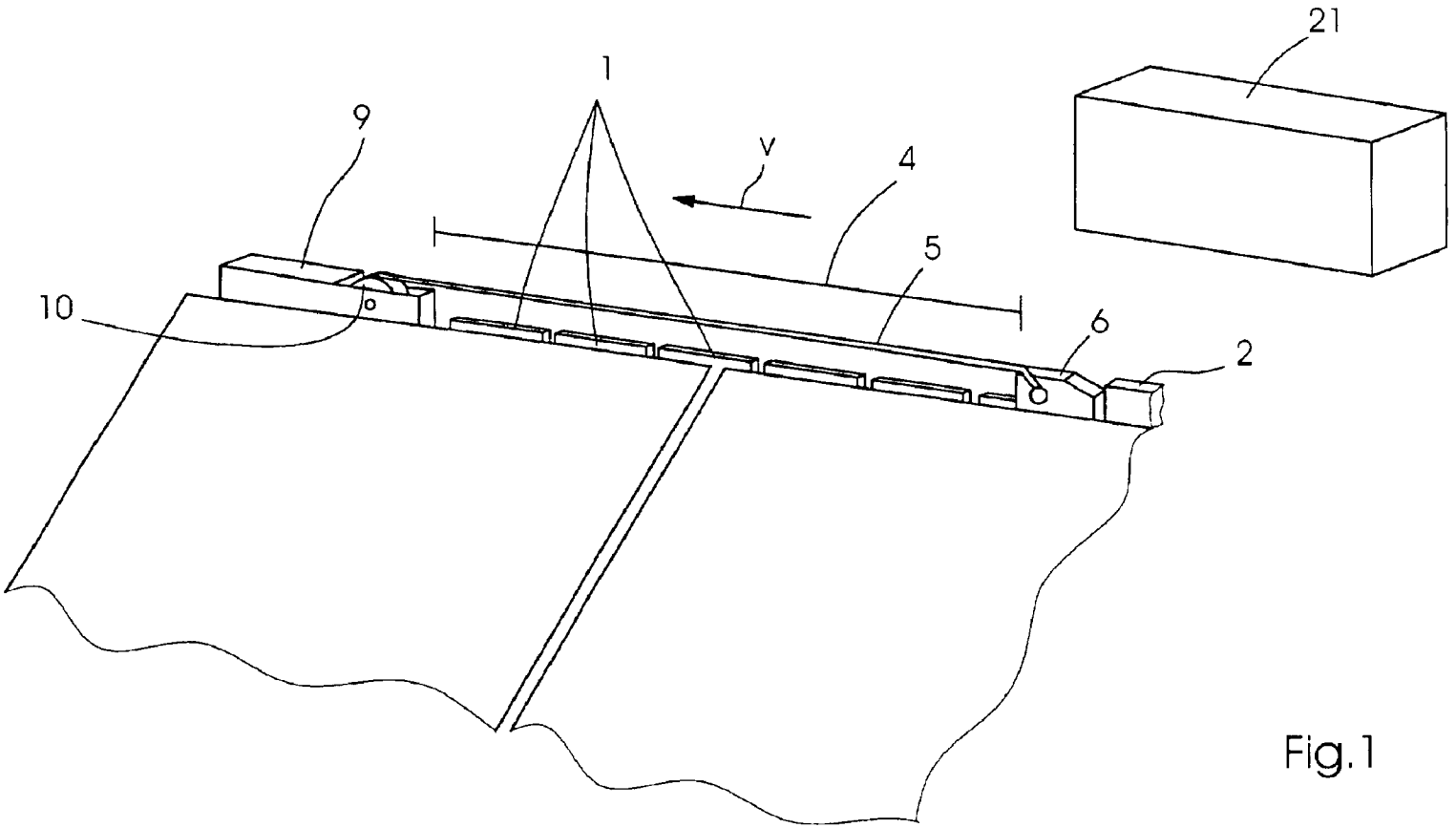
FIG. 1 is a diagrammatic perspective view of an outlet region of a stitching station with a preferred embodiment of a stitching device according to the invention.

Referring now to the drawings and, first, particularly to FIG. 1 thereof, there is shown therein, in a diagrammatic perspective view, an outlet region 4 of a stitching station with a preferred embodiment of a stitching device according to the invention. In this preferred embodiment of a stitching device, to effect entrained or following travel, also referred to as synchronous travel, a guide element is provided with a steel cable 5 traveling with a stitching carriage 2 and preferably coated, so that guidance, support and reliable positioning of printed products in the stitching region is improved by closing oscillating interspaces or gaps at the stitching carriage 2. The steel cable 5 therefore constitutes an entrained or synchronous stitching line. In detail, FIG. 1 shows, in the outlet region 4 of the stitching station, a rear gathering chain 1 which, in the stitching region of a currently conventional stitching machine, forms a transport device for the printed products to be stitched or the plurality of folded signatures to be stitched. The transport device formed by the gathering chain 1 moves at a transport speed v. The stitching station includes the stitching carriage 2 and a stitching head 21, by which staple stitching of the plurality of signatures transported past is performed. The stitching carriage 2 has the guide piece 6 assigned thereto and, starting from the guide piece 6, over the outlet region 4, the cable 5 extends to an outlet of a stitching region 9, an element which is arranged downline. Provided at the outlet of the stitching region 9 is a deflection roller 10, by which the cable 5 is deflected out of the stitching line.

Figure 2:
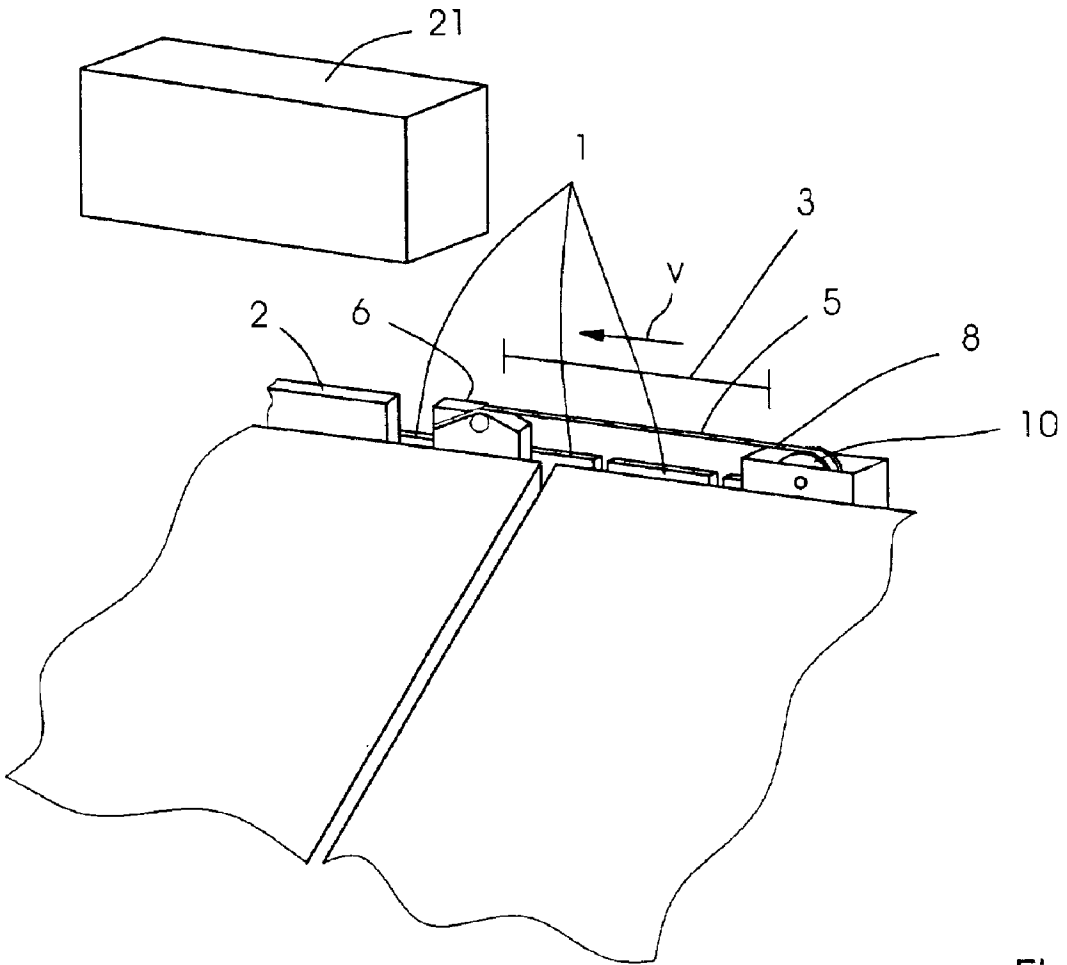
FIG. 2 is a diagrammatic perspective view of an inlet region of a stitching station with a preferred embodiment of the stitching device according to the invention.

FIG. 2 is a diagrammatic perspective view of an inlet region 3 of the stitching station with a preferred embodiment of the stitching device according to the invention. In the inlet region 3 of the stitching station, a transport device is formed by a rear gathering chain 1, which moves at the transport speed v. As in FIG. 1, the stitching carriage 2 and the stitching head 21 of the stitching station are shown. Starting from an inlet of the stitching region 8, which includes a deflection roller 10, the cable 5 extends along the stitching line through the inlet region 3 to a guide piece 6 assigned to the stitching carriage 2.

Figure 3:
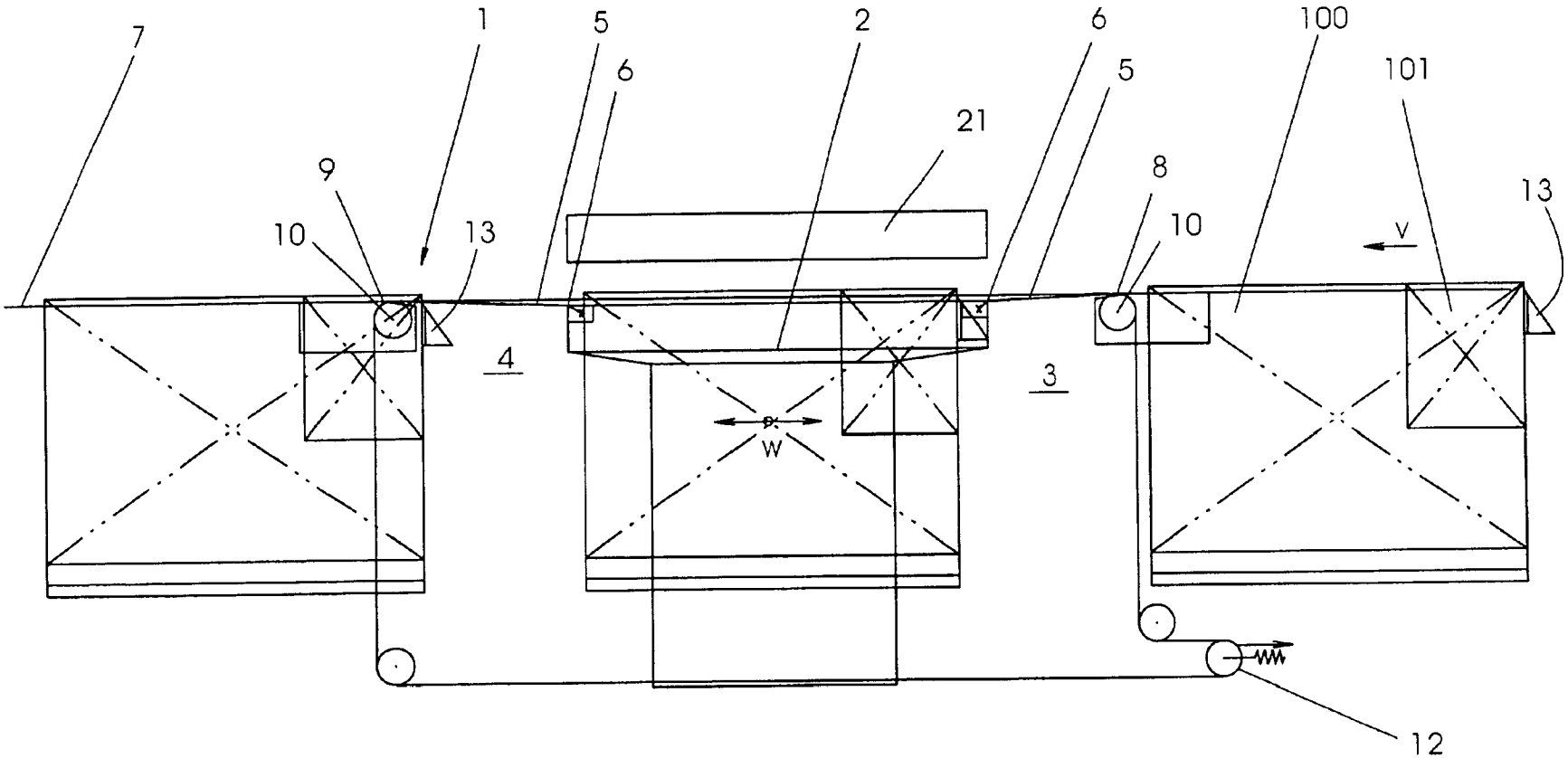
FIG. 3 is a diagrammatic side elevational view of a stitching region with a preferred embodiment of the stitching device according to the invention in a gathering-stitching machine.

FIG. 3 is a diagrammatic side elevational view of the stitching region with a preferred embodiment of the stitching device according to the invention in a gathering-stitching machine. In the stitching region, the transport device is formed by the rear gathering chain 1 which, by entrainers or drivers 13, conveys a plurality of folded signatures 100 groupwise, at an at least approximately constant transport speed v, past a stitching station which has a stitching carriage 2 and a stitching head 21. A plurality of folded signatures frequently has a small printed product or an inserted card 101. In the device according to the invention, the stitching is often performed during the entraining or following travel, i.e., the synchronous travel, at approximately the transport speed v. For a stitching operation of a plurality of folded signatures 100, the stitching carriage 2 carries out an oscillating movement w in a region between a starting point (first extreme point) and an end point (second extreme point). When the stitching carriage 2 is moved in a direction opposite to the direction defined by the transport speed vector v, gaps are produced alternately at the inlet region 3 and the outlet region 4 of the stitching carriage 2. The cable 5 is accommodated in the guide pieces 6, respectively, on the front and on the rear side of the stitching carriage 2, and extends at least approximately along a stitching line 7. The cable 5 moves at the same speed as the stitching carriage 2. The inlet to the stitching region 8 is typically formed by a saddle strip, and the outlet of the stitching region 9 is typically formed by a staple inspection or control device.

The path of the cable 5 is deflected out of the stitching line 7 at the start of the inlet region 3 at the inlet into the stitching region 8, and at the end of the outlet region 4 at the outlet from the stitching region 9 by virtually stationary deflection rollers 10, and is closed underneath the transport device, i.e., the rear gathering chain 1. In addition, further deflection rollers are provided. The cable 5 therefore extends from a rear guide piece 6 on the stitching carriage 2, over the outlet 9, over the deflection rollers belonging to the inlet 8 to a front guide piece 6 on the stitching carriage 2. Furthermore, the device has a tensioning element 12 which, through the intermediary of a restoring element, ensures an at least approximately constant cable tension and, if necessary or desirable, compensates for occurring adjusting movements, in particular, cable length changes. It should be emphasized that the tautened, continuous cable does not interfere with the drives and movement sequences within the machine, nor have any adverse effect thereon.

Figure 4:
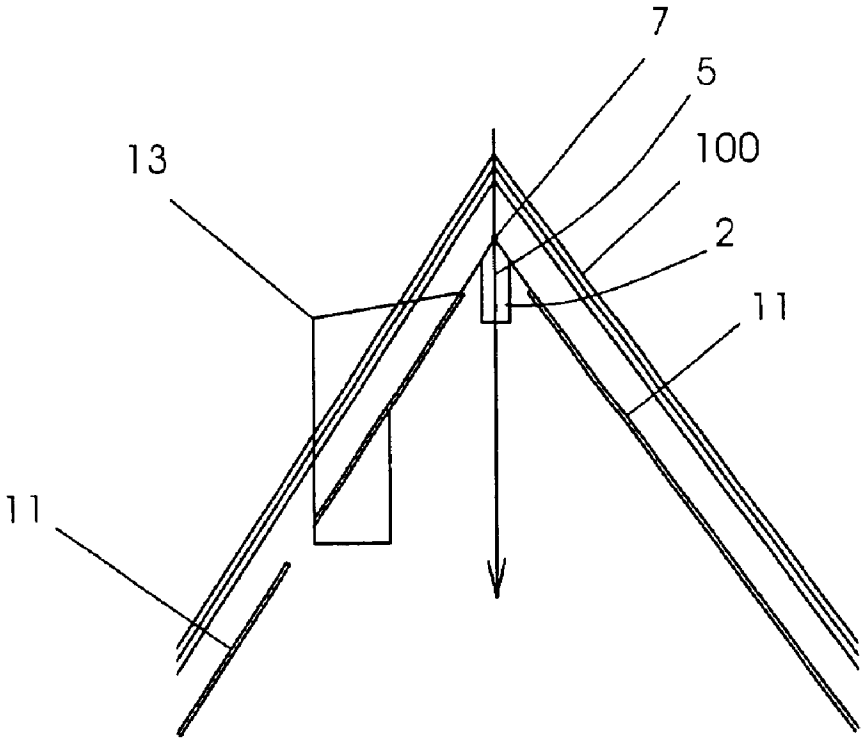
FIG. 4 is a diagrammatic view taken along a stitching line of a switching region, with a preferred embodiment of the stitching device according to the invention in a gathering-stitching machine.

FIG. 4 represents a diagrammatic view taken along the stitching line of the stitching region with a preferred embodiment of the stitching device according to the invention in a gathering-stitching machine. The plurality of folded signatures 100 is conveyed past the entrainingly moved stitching carriage 2, perpendicularly to the plane of the drawing of FIG. 4, by an entrainer or driver 13 straddling the sheet guide plates 11. The fold forms the connecting line of the support points, and the support line, respectively, on the cable 5, which extends along the stitching line 7.

For those skilled in the art, it is likewise possible to perform slight modifications and/or developments of the advantageous embodiment of the stitching device according to the invention. For example, the path of the cable 5 can be open: in other words, a respective cable is provided in the inlet region and in the outlet region, against a restoring element or pull-back element, such as a tension spring, a torsion spring, a sprung lever or the like, and forms the support line in the inlet region and in the outlet region, respectively. The path of the cable can also be closed within the stitching carriage, i.e., if necessary or desirable, can extend from the front to the rear guide elements through the intermediary of deflection elements. The cable can also be formed so as to be stationary, if a deflection of the stitching line within the carriage is provided. The stitching carriage can then execute a movement relative to the cable.

In summary, it is noted that, with the stitching device according to the invention, printed products, folded sheets or folded signatures are conveyed by the cable virtually without collision while avoiding tilting and contact at the height or level of the stitching carriage and a device disposed downline of the stitching carriage, respectively, while avoiding damage. Particularly when the stitching carriage stroke or elements disposed downline are vertically adjustable, height differences upline and downline from the stitching carriage and the clincher region itself are better compensated for by the guide element according to the invention. Machine stoppages and machine failures are reduced, the product run is quieter, and reliable inspection or control of the staples is possible.

We claim:

1. A stitching device comprising:

at least one stitching station for stitching a plurality of folded signatures, said stitching station having an inlet region, an outlet region, a stitching head, and a stitching carriage;

a transport device for conveying the plurality of folded signatures through said inlet region to said stitching station and for conveying the stitched plurality of folded signatures away from said stitching station through said outlet region; and a guide element for supporting the plurality of folded signatures during transport thereof through at least one of said inlet and said outlet regions, said guide element traveling together with said stitching carriage for closing oscillating gaps at said stitching carriage.

2. The stitching device according to claim 1, wherein said guide element supports the plurality of folded signatures from a side of said transport device by at least one support point located at least approximately in the fold of the innermost signature of the plurality of folded signatures.

3. The stitching device according to claim 2, wherein said guide element supports the plurality of folded signatures from said side of said transport device by at least two support points having a connecting line extending at least approximately parallel to the fold of the plurality of folded signatures or a support line.

4. The stitching device according to claim 3, wherein the connecting line and the support line are formed at least approximately by the fold of the plurality of folded signatures.

5. The stitching device according to claim 1, wherein said guide element extends at least approximately over an entire section from an inlet of a stitching region to an outlet of the stitching region.

6. The stitching device according to claim 1, wherein said stitching carriage is movable relative to said transport device so that, while at least one staple is being driven into the plurality of folded signatures, the relative speed between said stitching carriage and the plurality of folded signatures moved by said transport device is at least approximately zero.

7. The stitching device according to claim 2, wherein the at least one support point is movable together with the plurality of folded signatures during transport thereof, at least by sections, at an at least approximate relative speed of zero.

8. The stitching device according to claim 1, wherein said guide element is a cable.

9. The stitching device according to claim 8, wherein said cable is a steel cable.

10. A gathering-stitching machine having a stitching device, the stitching device comprising:

at least one stitching station for stitching a plurality of folded signatures, said stitching station having an inlet region, an outlet region, a stitching head, and a stitching carriage;

a transport device for conveying the plurality of folded signatures through said inlet region to said stitching station and for conveying the stitched plurality of folded signatures away from said stitching station through said outlet region; and a guide element for supporting the plurality of folded signatures during transport thereof through at least one of said inlet and said outlet regions, said guide element traveling together with said stitching carriage for closing oscillating gaps at said stitching carriage.

* * * * *